US005987659A

United States Patent [19]

Cannizzaro

[11] Patent Number: 5,987,659

[45] Date of Patent: Nov. 23, 1999

[54] BIDET DEVICE PROVIDING REPEATABLE SOLUTION TREATMENTS

[76] Inventor: Carl C. Cannizzaro, 21400 Tudor Dr., Boca Raton, Fla. 33486-1411

[21] Appl. No.: 09/042,563

[22] Filed: Mar. 17, 1998

Related U.S. Application Data

[63] Continuation-in-part of application No. 08/650,462, May 20, 1996, abandoned.

[51] Int. Cl.[6] ..... A47K 3/22

[52] U.S. Cl. ..... 4/420.2; 4/420.4

[58] Field of Search ..... 4/420.1–420.5, 4/443–446

[56] References Cited

U.S. PATENT DOCUMENTS

| | | | |
|---|---|---|---|
| 3,577,567 | 5/1971 | Wintercorn | 4/420.1 |
| 3,947,899 | 4/1976 | Robinson et al. | 4/420.2 X |
| 4,287,618 | 9/1981 | Silver | 4/420.2 X |
| 4,326,308 | 4/1982 | Silver | 4/420.4 X |
| 4,550,454 | 11/1985 | Yui | 4/420.3 X |
| 4,903,347 | 2/1990 | Garcia et al. | 4/420.4 |
| 4,995,121 | 2/1991 | Barker | 4/443 |

*Primary Examiner*—Charles E. Phillips
*Attorney, Agent, or Firm*—Oltman, Flynn & Kubler

[57] ABSTRACT

A bidet apparatus includes a building fixture having a water pipe carrying pressurized water; a valve connector tube having a connector tube first end and a connector tube second end; a water pipe coupling structure coupling the connector tube to the water pipe so that the water pipe and the connector tube first end are in fluid communication; a mixing valve including a water inlet structure coupled to the connector tube second end, a medication inlet structure and a squeeze bottle containing medication and coupled to the medication inlet structure through a bottle coupler structure containing a check valve oriented to obstruct liquid flow into the bottle from the mixing valve structure, an internal mixing cavity in which the medication from the bottle and the water from the water pipe are mixed to produce a liquid mixture, a mixture outlet structure including an outlet coupling structure; a flexible mixture delivery tube having a delivery tube first end and a delivery tube second end, the delivery tube first end being coupled to the mixture outlet structure by the outlet coupling structure; a nozzle structure coupled to the delivery tube second end by a nozzle coupling structure; and a water flow control mechanism.

5 Claims, 3 Drawing Sheets

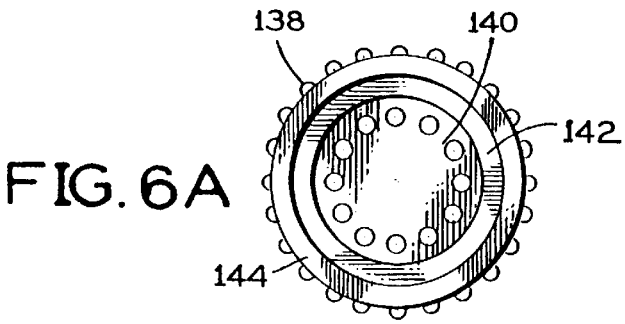
FIG. 6A
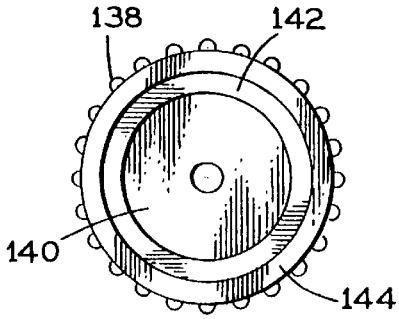
FIG. 6B
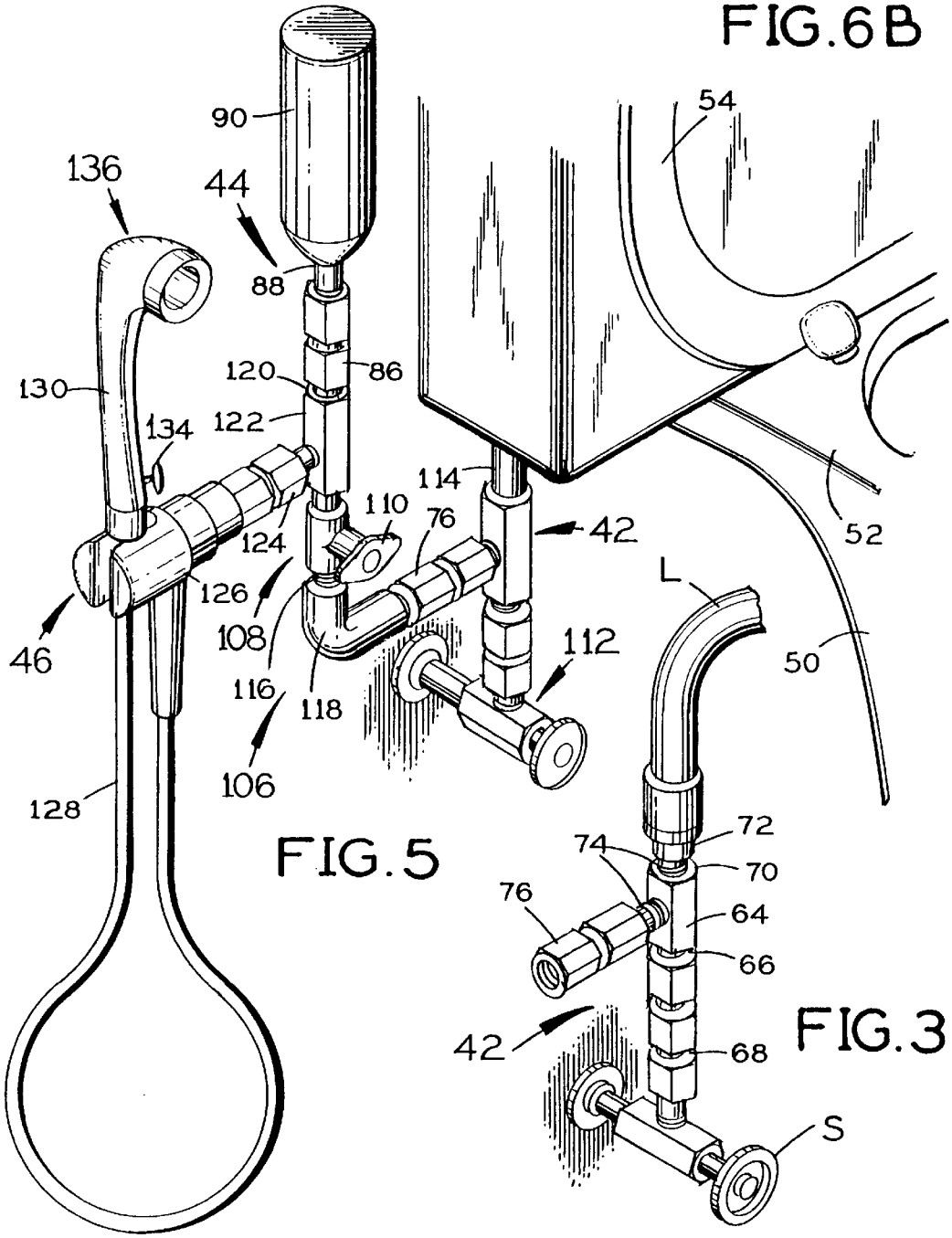
FIG. 5
FIG. 3

BIDET DEVICE PROVIDING REPEATABLE SOLUTION TREATMENTS

This application is a continuation-in-part of application Ser. No. 08/650,462 filed on May 20, 1996, ABN.

BACKGROUND OF THE INVENTION

1. Field of the Invention

This invention relates to hygienic devices and in particular to bidets.

2. Description of the Prior Art

Bidets have been found to be superior to the use of toilet paper for cleansing the anal-genital area of the human body. They have also provided relief for sufferers with hemorrhoids, fissures, and similar ailments. The conventional bidet is a free standing fixture with attached plumbing that provides water and drainage. A user sits on the porcelain rim of the bidet and adjusts the flow is and temperature of water with a control knob. Body position is then readjusted to accommodate the flow of water from fixed jets within the bowl. The reason that more people do not enjoy the benefits of a bidet is largely due to the extra space and expense a free standing bidet requires. Many owners of bidets find it inconvenient to move to a unit separate from the toilet. Yet shorter hospital stays, elderly home care and the AIDS crisis have created a greater need for this kind of cleansing. A wide variety of disposable douches, enemas, and wet wipes on the market have tried to meet this need. The problem is that the manufacture and disposal of these products use up valuable resources and despoil the environment. Thus a number of bidet devices and seats have been proposed for use with an ordinary flush toilet.

A primary object of a bidet device is to apply warm water to the anal-genital area of the user of a toilet. A number of such devices are electrically heated. For example, in U.S. Pat. No. 4,622,704 to Chung (1986), a lower reservoir is adapted to receive and electrically heat cold water from a refillable upper reservoir. The heated water is then transferred through a flexible hose to a handheld nozzle with a manual or electrical pump. In U.S. Pat. No. 4,422,190 to Huang (1983), an electric control system heats water inside a jacketed toilet seat, connected to the toilet water supply source. The system comprises a power source connector, a circuit breaker, a transformer for reducing input voltage, a heating coil and a thermostat, connected by a sensor inserted in the water of the jacket. The malfunction of any of these mechanisms in a moist environment, particularly if extension cords are used, may cause temperature and electrical shock for the user. Thus number of devices, using both the hot and cold water supply, have been proposed.

Some of these devices include a hand-held nozzle with a volume control that is attached to a sink faucet with a flexible hose. Here, the volume and temperature controls are often not accessible to the toilet. Pressure build-up or disconnection from the faucet could cause leakage, and water temperature cannot be changed. Thus some devices provide their own mixing valve, connected directly to the hot and cold water supply stops. Most of these devices, including U.S. Pat. No. 4,041,553 to Sussman (1977), U.S. Pat. No. 4,807,311 to Ingels (1989), and U.S. Pat. No. 4,995,121 to Barker (1991), provide external handles for adjusting the position of nozzles inside the bowl area. Their elaborate configurations restrict directional movement and are difficult to keep clean. U.S. Pat. No. 5,025,510 to Basile (1991), stores a hand-held nozzle with a flexible conduit within a compartment of the toilet or seat. While protected from elimination materials, the nozzle head is subject to mildew and mold which readily grow in the moist environment. Self-contained hand-held bidets, such as U.S. Pat. No. 4,890,340 to Lovitt (1990), are stored in a dry sanitary place but do not provide the continuous flow of water of the seat and bidet attachments.

Another object of the bidet device is to dispense a medicine or cleanser in series with the flow of water for internal and external body treatments. In U.S. Pat. No. 4,622,704 to Chung (1986) and U.S. Pat. No. 5,097,540 to Lovitt (1992), a liquid soap is somehow added to an internal chamber of a discharge handle and dispensed with the flow of water. A pump is used to dispense the liquid while the solution is being directed to the desired body area. This process may prove to be difficult for certain users. In U.S. Pat. No. 4,130,118 to McLaughlin (1978), a discharge apparatus holds a cartridge, containing solid salts, that is dissolved with the flow of warm water. These cartridges are more expensive and limited than the over-the-counter liquids used in many applications. Also, the increased weight and size of all these handles can make them awkward to maneuver. The limited volume of their reservoirs prevents multiple or extended treatments. These reservoirs must first be emptied before new liquids are added to apply different solutions.

A further object of the bidet device is to provide a safe and sanitary nozzle for applying both internal and external body treatments. The discharge nozzles of the prior art are elongated in shape and have attached disposable tips for applying internal body treatments such as douches and enemas. The insertion of these nozzle tips may irritate the sensitive lining of a body cavity especially for those suffering from hemorrhoids or, recovering from surgery. In addition, these tips can be expensive to purchase and present a disposal waste problem. In U.S. Pat. No. 4,764,997 to Anderson (1988), external heat therapy is administered with a sitz bathe adapted for such a nozzle. The integral molded channel of the sitz bathe restricts the free range of movement of the bidet. There is also the danger of contaminants being inadvertently introduced by the user during the soaking phase. Thus, independent self administration of these body treatments is often difficult.

Another object of the bidet device is to provide greater accessibility to the general population. Bidet devices thus far have been marketed to persons with special needs and tend to be automated to increase convenience. These mechanisms have complicated and expensive control and heating mechanisms that require electricity to operate. Often these functions are performed more efficiently by less complex and commercially made components. Thus a simple, more economical method of production needs to be explored.

A further object of a bidet device is to provide convenience of use without appearing obtrusive. Special seats that have nozzles located inside the toilet bowl modify the appearance of the toilet. Their proximity to the toilet bowl make them difficult to clean, and may cause unpleasant odors. Self-contained and portable hand-held bidets are either inconveniently stored out of sight or require an obtrusive reservoir tank for attachment.

A further advantage of a bidet device is to provide related solution-rinse applications with a sink basin or a shower. The elongated nozzle heads of the cited prior art can be only used with a toilet. They are not versatile enough to provide treatments to other parts of the body with a sink or a shower. Infant bathing, hair treatments, and body washes are applications that require a round nozzle head similar to that of an ordinary hand shower.

Accordingly, several objects and advantages of the present invention are:

(a) to provide a safe, efficient and sanitary warm water delivery system.

(b) to provide a safe, reusable nozzle head for both external and internal treatments.

(c) to provide a liquid dispenser that can be quickly changed for different applications.

(d) to make the device more affordable to purchase, use and maintain.

(e) to provide convenience for the user without having an obtrusive appearance.

(f) to provide a versatile nozzle head for related applications with a sink or shower.

Further objects and advantages include adaptations of self-adjustment mechanisms, currently used in showers and garden hose nozzles to modify discharge patterns. Still further objects and advantages will become apparent from a consideration of the ensuing description and drawings.

SUMMARY OF THE INVENTION

The present invention accomplishes the above-stated objectives, as well as others, as may be determined by a fair reading and interpretation of the entire specification.

A bidet apparatus is provided including a building fixture having a water pipe carrying pressurized water; a valve connector tube having a connector tube first end and a connector tube second end; a water pipe coupling structure coupling the connector tube to the water pipe so that the water pipe and the connector tube first end are in fluid communication; a mixing valve including a water inlet structure coupled to the connector tube second end, a medication inlet structure and a squeeze bottle containing medication and coupled to the medication inlet structure through a bottle coupler structure containing a check valve oriented to obstruct liquid flow into the bottle from the mixing valve structure, an internal mixing cavity in which the medication from the bottle and the water from the water pipe are mixed to produce a liquid mixture, a mixture outlet structure including an outlet coupling structure; a flexible mixture delivery tube having a delivery tube first end and a delivery tube second end, the delivery tube first end being coupled to the mixture outlet structure by the outlet coupling structure; a nozzle structure coupled to the delivery tube second end by a nozzle coupling structure; and a water flow control mechanism.

The building fixture preferably includes a hot water pipe carrying pressurized hot water and a cold water pipe carrying pressurized cold water, and a first said valve connector tube is preferably coupled with the water pipe coupling structure to the hot water pipe and a second said valve connector tube is coupled with the water pipe coupling structure to the cold water pipe, and a first water inlet means is preferably coupled with the connector tube coupling structure to the first valve connector tube and a second water inlet structure is preferably coupled with the connector tube coupling structure to the second valve connector tube, and the mixing valve preferably includes a mechanism for altering the ratio of pressurized hot water and pressurized cold water entering the mixing cavity from the first and second valve connector tubes to adjust liquid mixture temperature.

The water pipe coupling structure preferably includes a T-shaped pipe fitting fitted into a break in the water pipe. The building fixture is preferably a sink or a toilet. The water flow control mechanism preferably includes a valve in the nozzle structure.

BRIEF DESCRIPTION OF THE DRAWINGS

Various other objects, advantages, and features of the invention will become apparent to those skilled in the art from the following discussion taken in conjunction with the following drawings, in which:

FIG. 3 shows a perspective detailed view of a diverter tee assembly illustrated in FIG. 1.

FIG. 5 is a perspective view of an alternative embodiment showing an unheated water transporting system supplied with a three port adapted ball valve.

FIGS. 6A and 6B show plan views of adaptations of the pattern portion in FIG. 5.

DETAILED DESCRIPTION OF THE PREFERRED EMBODIMENTS

Figure 1:
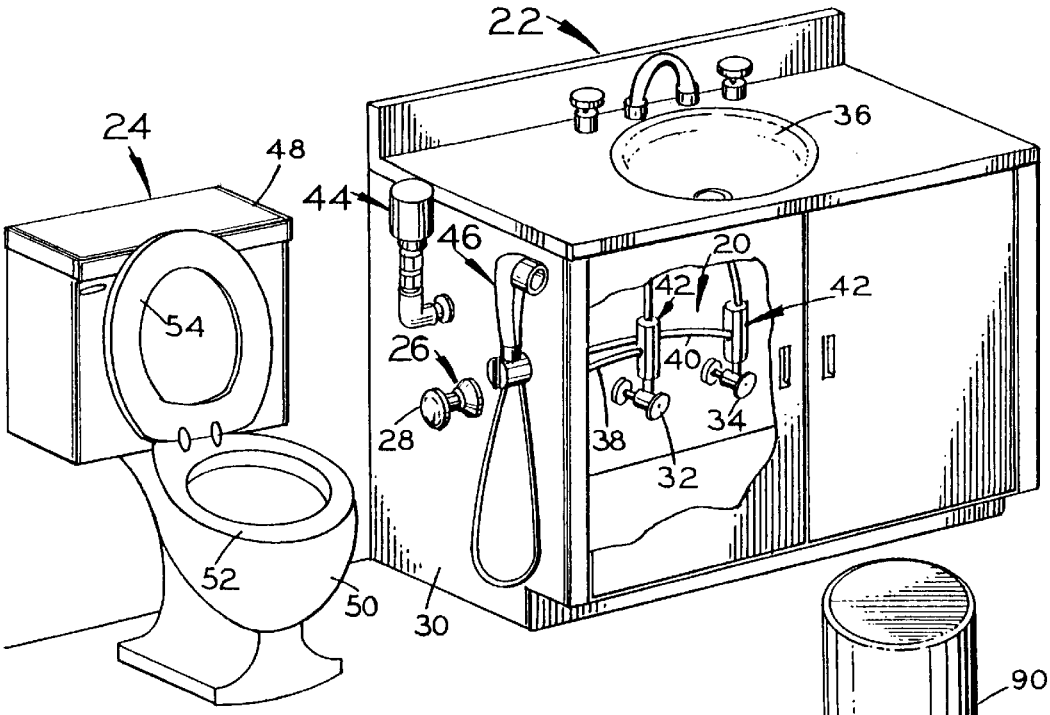
FIG. 1 is a perspective view of the preferred embodiment housed in a sink vanity (cutway) showing a heated water transporting system supplied with a mixing valve assembly.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIG. 1, a preferred embodiment of the bidet device has a heated water transporting system generally indicated by reference numeral 20 and shown housed in a sink vanity 22 adjacent to a flush toilet 24. Transporting system 20 includes a four-port mixing valve assembly, generally indicated by reference numeral 26, centrally mounted on the internal side of a side panel 30 of vanity 22, protruding through a sized opening and externally attached to a temperature/volume control knob 28. Valve assembly 26 is internally connected to the existing hot and cold water supply stops 32 and 34, feeding sink basin 36, through the hot and cold water supply lines 38 and 40, attached to a diverter assembly 42 mounted on each stop. Supply lines 38 and 40 can be made of polyethylene tubing that has been adapted on each end for attachment with the appropriate male tube adapters. A liquid dispenser assembly generally indicated by reference numeral 44, and a discharge nozzle generally indicated by reference numeral 46 are connected to valve assembly 26 on the external side of side panel 30 through sized openings disposed above and below control knob 28. Flush toilet 24, adjacent to vanity 22, includes a water reservoir tank 48, a bowl 50 having a generally oval flat rim 52, and a generally oval seat and lid assembly 54. Rim 52 has an approximately 3.5 cm width and is similar in size and shape to the flat rim of the bowl of a free standing bidet. Seat assembly 54, mounted on the rear portion of rim 52 in the usual and customary manner, is pivotally rotated in a vertical position.

Figure 2:
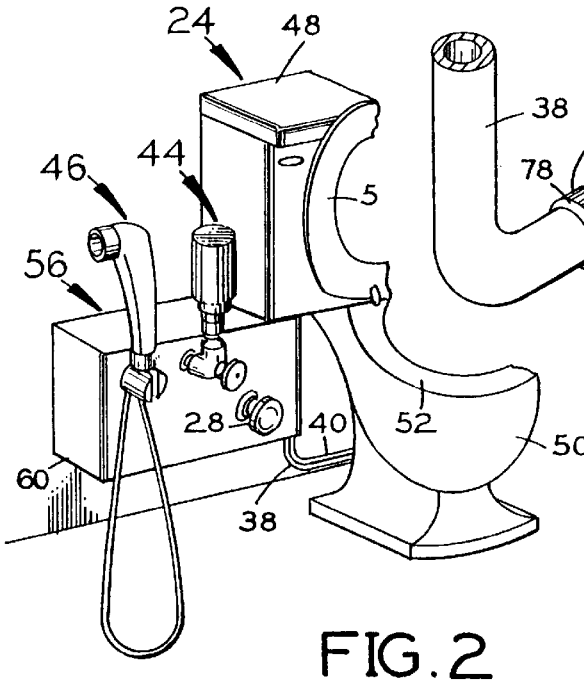
FIG. 2 is a perspective view of the valve assembly in FIG. 1 in a portable box housing.

In FIG. 2, a portable boxed housing 56 contains valve assembly 26 and is mounted on a wall to the rear of toilet 24, partially under tank 48. Dispenser and nozzle assemblies 44 and 46, and control knob 28 are connected to valve assembly 26 on a front panel 58 as described on side panel 30 of vanity 22 (FIG. 1). Supply lines 38 and 40, gathered and extended through an opening in a bottom panel 60, are mounted on a floor molding 62.

In FIG. 3, diverter assembly 42 (FIG. 1), comprises a male branch diverter tee 64, having three adapted openings or ports. A lower inlet port 66 is connected to an existing water supply stop S with a male tube adapter assembly 68. Assembly 68 is comprised of a male tube adapter attached to a stainless steel tubing that has been adapted at both ends with a nut and ferrule, forming a noncompressible seal with supply stop S. An upper outlet port 70 is connected to an existing supply line L with a male tube adapter 72 and an intermediate outlet port 74 has a check valve 76 leading to the nozzle assembly 46 (FIG. 1).

Figure 4:
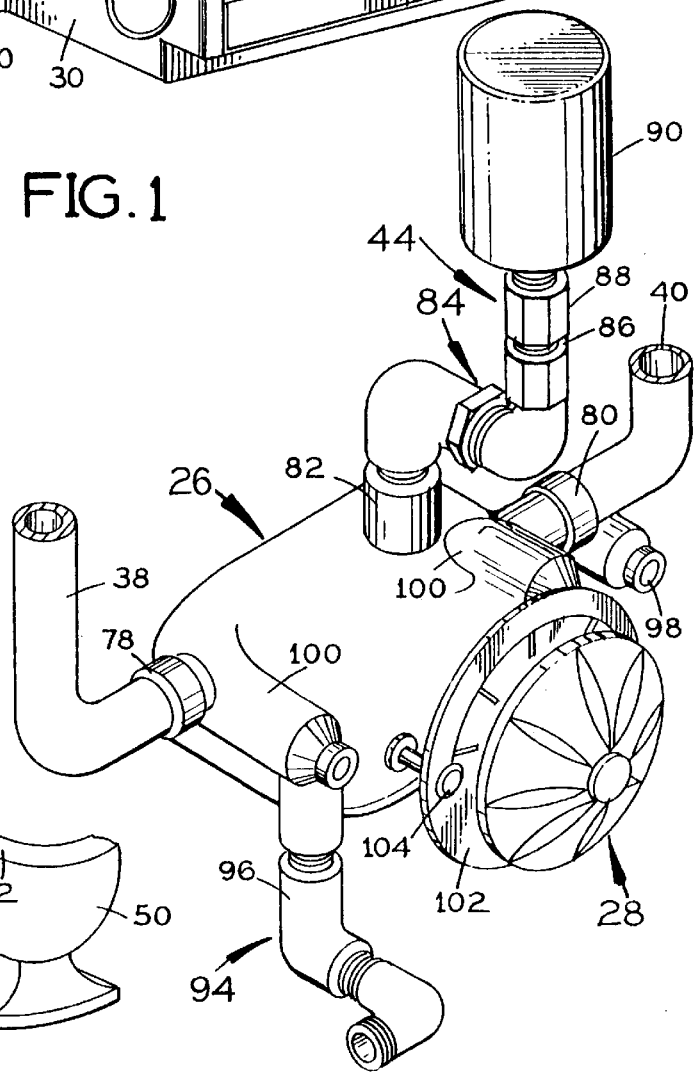
FIG. 4 shows a perspective detailed view of the valve and dispenser assemblies in FIG. 1.

In FIG. 4, four-port mixing valve assembly 26, illustrated in FIGS. 1 and 2, has three inlet ports and one outlet port. Hot and cold water inlet ports 78 and 80 are connected to the supply lines 38 and 40. An upper inlet port 82 is connected to dispenser assembly 44 with the adapted elbow nipple and check valve assemblies 84 and 86. Elbow nipple assembly 84 is comprised of two street elbows joined with a hex bushing adapter that is connected to the outlet end of check valve assembly 86 with a nipple. Adapted check valve assembly 86 comprised of its check valve having its inlet end adapted for releasible engagement with a luer lock adapted cap 88 attached to a dispenser bottle 90 of dispenser assembly 44. The check valve preferably has a cracking pressure that provides minimal resistance when liquid is dispensed by compressing bottle 90. Bottle 90 is preferably made of pliable clear plastic having graduated markings that permit visible measurement. A lower outlet port 92 of valve assembly 26 is fitted with a dual elbow assembly 94, comprised of two street elbows joined with a nipple that provides the connection with nozzle assembly 46 (FIGS. 1 and 2). Valve assembly 26 has an internal pressure balancing mechanism (not shown) showing a hot water balancing spool 96, a cold water balancing spool 98 and a temperature stop 100. A circular flange 102 fastens and supports valve assembly 26 with a screw assembly 104 in the usual and customary manner.

Figure 7A:
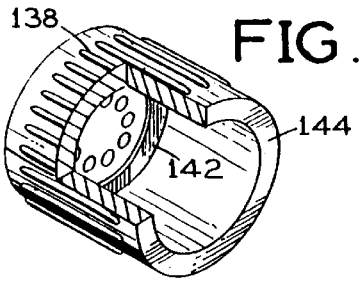
FIGS. 7A and 7B show perspective views of adaptations of the edge portion in FIG. 5.
Figure 7B:
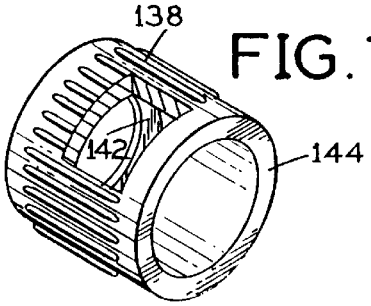

In FIG. 5, an alternative embodiment of the present invention has an unheated water transporting system generally indicated by reference numeral 106. In transporting system 106, a three port adapted ball valve 108 comprised of a ball valve fitted with a male branch tee has an on/off control knob 110 and is connected to diverter assembly 42 mounted between an existing toilet water supply stop 112 and an existing toilet water supply tube 114. A lower inlet port 116 of adapted ball valve 108 is connected to check valve 76 of diverter assembly 42 with an elbow assembly 118, comprised of a nipple joined with a street elbow. An upper inlet port 120 is attached to adapted check valve assembly 86. An intermediate outlet port 122 is connected to nozzle assembly 46 with a hex bushing adaptor 124. Nozzle assembly 46 is comprised of a rotatable conduit holder assembly 126, a flexible hose 128, a rigid curved molded handle 130, a volume control 132 having a partial shut off knob 134, and a nozzle head 136. Holder assembly 126 is a standard rotatable ball and socket conduit joint that demountably supports handle 130. Nozzle head 136 is threadably attached to handle 130. In FIG. 6A, nozzle head 136 is shown to have an external knurled portion 138, surrounding a recessed pattern portion 140 with an internal shrouded portion 142 having a flat edge 144. Recessed pattern 140 has a circular array of openings in FIG. 6A and a centrally located opening in FIG. 6B. Edge 144 is adapted with a brush surface in FIG. 7A and is adapted with an irregular ridged surface in FIG. 7.

Figure 8:
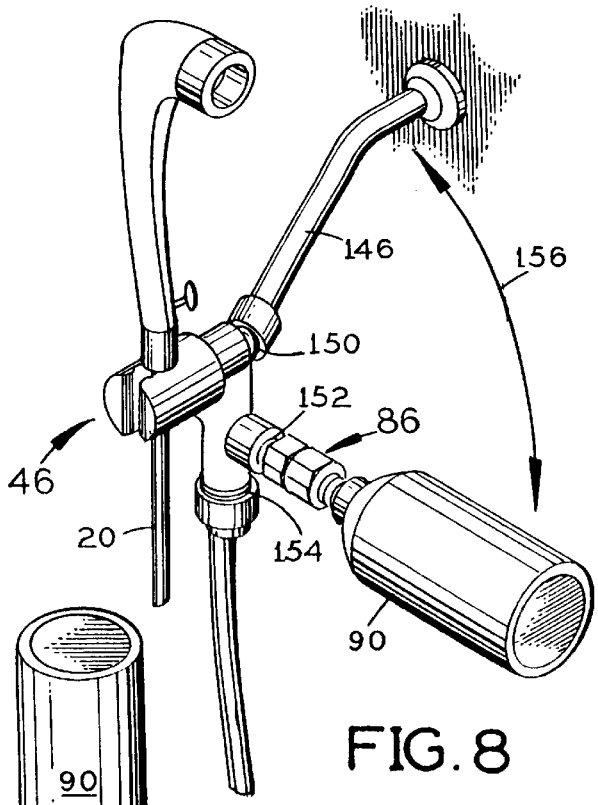
FIG. 8 shows a perspective view of the nozzle assembly adapted for a shower arm.

In FIG. 8, heated water transporting system 20 is adapted to an existing shower arm 146 with holder assembly 126 attached to the outlet and connected to dispenser and nozzle assemblies 44 and 46 with an adapted tee 148. Adapted tee 148 has two inlet ports and one outlet port. Upper inlet port 150 is attached to holder assembly 126. Intermediate inlet port 152, adapted with a check valve assembly 86, is removably attached to cap 88 of dispenser assembly 44. Lower outlet port 154, adapted with a nipple, is attached to flexible hose 128 of nozzle assembly 46. As shown by an arcuate arrow 156, dispenser bottle 90 is rotatable from a horizontal position to a vertical position at a 90 degree angle. From the description above, a number of advantages of my bidet device supplying repeatable solution treatments become evident:

(a) The warm water delivery system of the preferred embodiment provides the user of a toilet or sink with a continuous flow of adjustable warm water without the need for complicated delivery and directional mechanisms. A tee assembly, comprised of common fittings, supplies water to the bidet assembly without interfering with the existing valve assembly of the sink or toilet. The stainless steel tubing assembly provides a rigid and water tight connection between the supply line and the existing stop at a critical point. In the preferred embodiment, a pressure-balanced mixing valve conveniently supplies water of a consistent prescribed temperature to the user of a toilet or a sink. An alternative embodiment, suitable for warm climates, supplies naturally warm water feeding the toilet tank with a three port adapted ball valve. In both embodiments, the user directs a hand-held nozzle to the desired area without having to adjust body position or operate an external handle.

(b) The nozzle head can be adapted to apply a wide variety of internal and external body treatments without the need for disposable tips or extra equipment. When held away from the surface of the skin, a wide stimulating spray provides a sitz bath-type treatment. When the edge of the shrouded portion of the nozzle head is held close to a body opening, the discharge spray is externally directed into a body cavity to provide douche and enema-type cleansing. Nozzles are easily removed for sanitization and reused.

(c) The dispenser assembly of the present invention is simple and inexpensive to use. The check valve, often used as an anti-siphon device to prevent back flow of a liquid when the control valve is closed is here used to prevent back flow of water into the dispenser bottle when the control valve is opened. This unorthodox use provides additional applications without refilling. Available over-the-counter liquids can be used instead of expensive manufactured cartridges. A number of advantages over a self-contained soap chamber are provided with an externally attached dispensing reservoir. The external reservoir can be larger than an internal reservoir and additional liquid can be stored within the valve and flexible hose cavities for extending body treatments. Visual measurements on the bottle provide more accurate dispensing of liquid. Quick disconnect fittings provide easy removal for cleaning, exchange of liquids and refilling for dispensing a variety of solutions. Because liquids are measured and added before the flow of water, the user is not forced to coordinate dispensing the liquid with directing the solution to the desired body area.

(d) The substantial use of commercially available components reduces the cost of production, replacement and modification. The cost is further reduced when duplicate fittings and valves are used. Threaded attachment makes these parts easy to replace for maintenance and modification purposes. Commercial check valves, control valves, and fittings have been tested with time and are less likely to need replacement.

(e) The appearance of the toilet sink and shower facilities are not significantly modified by the installation or use of the device. There is no restriction as to the shape of the toilet bowl or need for extra space for a reservoir tank and an electric cord. The device can be inconspicuously installed adjacent but separate from the toilet bowl. The control valve and nozzle assemblies are convenient to the user of a toilet without being unsanitary. Standard components have a variety of colors and styles that blend with bathroom decor.

(f) The nozzle assembly is flexible enough to apply related solution-rinse body treatments in conjunction with a sink or shower. The different shrouded edges of the nozzle heads and the partial strut-off knob on the bidet handle permit a variety of massage and cleansing treatments with one hand. Thus a small infant can be held with the other hand while being bathed. A handicapped person can perform basic hygienic tasks alone.

Operation—FIGS. 1, 2, 5, and 8

The manner of using the bidet to cleanse the anal-genital area of the user of a toilet is similar to that of a free-standing bidet. Namely, the user sits directly on the rim of the bowl, providing a natural gasket with the thighs, and adjusts an on-off control knob that directs a stream of water to a body area. The main differences are that the user remains on the toilet, uses the control knob to alternately receive a liquid medicine or soap and water under pressure, and directs the solution with a hand-held nozzle.

Referring now to FIG. 5, the user compresses dispenser bottle 90 inserting a measured amount of liquid into check valve assembly 86 forcing excess water to drain from the nozzle head into bowl 52. The user then opens control knob 110 of ball valve 108 and directs a solution upward towards a specific anal-genital area. By holding nozzle head 136 away from the surface of the skin, a wide stimulating spray is provided. By holding edge 144 of shrouded portion 142 against a body opening, douche and enema-type treatments can be administered. The user can then manipulate the partial strut-off knob 134 with the directing hand to control the volume without using control knob 110 on ball valve 108. When the area is thoroughly cleansed and rinsed, the user returns handle 130 to holder assembly 126 and pats the area dry with a clean cloth. Nozzle head 136 can then be sprayed with a disinfectant or removed for more thorough cleaning.

Referring now to FIGS. 1 and 2 the user preadjusts the water for temperature with control knob 28 of valve assembly 26, directing the initial surge of water into bowl 52 for anal-genital cleansing, or into sink basin 36 for hair or infant cleansing. Then the user proceeds in the manner as described in FIG. 5. With the water turned off, liquid is inserted into the control valve and the solution is applied to the body area with nozzle assembly 46.

Referring now to FIG. 8 the user of a shower utilizes the existing valve assembly to apply various hair and body treatments. The user, after horizontally attaching bottle 90 to check valve assembly 86 on intermediate inlet port 152 of adapted tee 148, rotates holder assembly 126 so that bottle 90 is in a vertical position for dispensing the liquid. Liquid is dispensed and a solution is applied in the manner described in FIGS. 1, 2 and 5.

Figure 9:
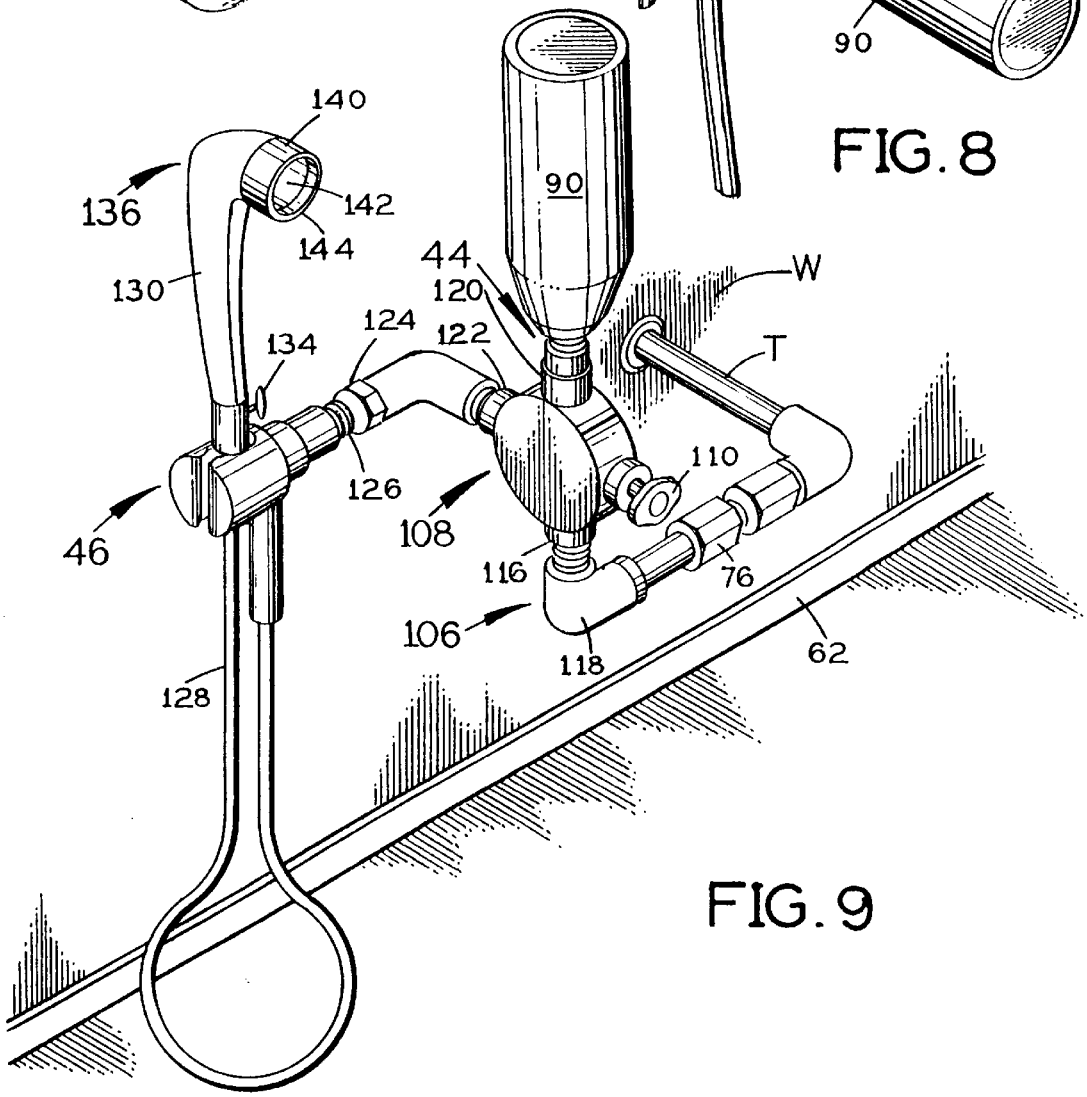
FIG. 9 is a perspective view of a still further embodiment of the apparatus fitted to a water pipe extending from a wall where there is no pre-existing fixture.

The bidet device may still alternatively extend from a water supply pipe within a building wall W which is not fitted to any existing fixture, as shown in FIG. 9. This bidet device is otherwise like that shown in FIG. 5, and connects to a single water line running within the building wall W, although the bidet embodiment shown in FIG. 1 may be used where both hot and cold water pipes run within the wall W. If the water supply pipe or pipes do not already protrude through the wall, a T-shaped connecter C of conventional design may be installed to carry the water out of the wall W and connected to the device.

Accordingly, the reader will see that my bidet device, providing repeatable solution treatments, can be used to apply a solution-rinse application with relative simplicity and convenience. The external bottle dispenser can be quickly removed, replaced or refilled. Thus liquids can be quickly exchanged to provide various as well as extended and multiple applications. A variety of different nozzle heads with different patterns and edge portions provide single-handed hair and body treatments in a sink or shower. Thorough cleansing of the anal-genital area avoids the need for abrasive and wasteful toilet paper and wet wipes. The use of tested standard parts to replace complicated mechanisms reduces production and maintenance costs.

Although the description above contains many specifications, these should not be construed as limiting the scope of the invention but as merely providing illustrations of some of the presently preferred embodiments of this invention. For example, the nozzle assembly can have other shapes and angle adjustment features such as nozzle head which can be rotated in a ball-in-socket joint and be comprised of a number of parts instead of a single molded form. The dispensing assembly can be adapted with tees to provide a plurality of openings to receive a variety of concentrates. The dispensing assembly can be adapted for use with a sink by pumping liquid into the mixing area of a faucet assembly.

In conclusion, there may be certain variations in the size, form, organization and materials of the parts shown as well as other applications of use not realized at this time, without departing from the basic functions and effectiveness of the invention. Thus the scope of the invention should be determined by the appended claims and their legal equivalents, rather than by the examples given.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A bidet apparatus comprising:

a building fixture having a water pipe carrying pressurized hot water and a pipe carrying pressurized cold water;

a mixing valve comprising a hot water inlet and a cold water inlet and a medication inlet, a squeeze bottle containing medication and coupled to said medication inlet through a bottle coupler structure containing a check valve oriented to obstruct liquid flow into said bottle from said mixing valve, an internal mixing cavity in which said medication from said bottle and said water from said water pipes are mixed to produce a liquid mixture, a liquid mixture outlet;

a hot water supply line connected between said hot water pipe and said hot water inlet and a cold water supply line connected between said cold water pipe and said cold water inlet;

said mixing valve having a knob for adjusting the temperature and volume of said liquid mixture upstream of said liquid mixture outlet;

a flexible mixture delivery tube having a delivery tube first end and a delivery tube second end, said delivery tube first end being coupled to said mixture outlet and said second end being coupled to a bidet nozzle assembly;

said bidet nozzle assembly comprising a rigid handle having a volume control and a nozzle head for release of said liquid mixture in stream or spray pattern.

2. An apparatus according to claim 1, wherein said water flow control means comprises a valve in said nozzle means.

3. An apparatus according to claim 1, wherein said water pipe coupling structure comprises a T-shaped pipe fitting fitted into a break in said water pipe.

4. An apparatus according to claim 1, wherein said building fixture is a sink.

5. An apparatus according to claim 1, wherein said building fixture is a toilet.

* * * * *